US006457434B1

(12) United States Patent
Lazar

(10) Patent No.: US 6,457,434 B1
(45) Date of Patent: Oct. 1, 2002

(54) WET/DRY TISSUE DISPENSER

(75) Inventor: Ari Lazar, Tel-Aviv (IL)

(73) Assignee: Rosita de Keersmaeker, Los Angeles, CA (US); part interest ( * ) Notice: Subject to any disclaimer, the term of this patent is extended or adjusted under 35 U.S.C. 154(b) by 0 days.

(21) Appl. No.: 09/791,142

(22) Filed: Feb. 22, 2001

(51) Int. Cl.[7] ..... B05C 5/02

(52) U.S. Cl. ..... 118/32; 118/40; 118/43; 118/314; 118/325; 242/908

(58) Field of Search ..... 118/32, 40, 43, 118/314, 325; 242/908, 596.8, 597.8, 598.6, 615

(56) References Cited

U.S. PATENT DOCUMENTS

| | | | | |
|---|---|---|---|---|
| 504,456 | A | * 9/1893 | Rhoades | |
| 3,776,773 | A | * 12/1973 | Taft | 118/325 |
| 3,804,061 | A | * 4/1974 | Cassar et al. | 118/325 |
| 3,837,595 | A | * 9/1974 | Boone | |
| 3,979,781 | A | * 9/1976 | Jolicoeur | |
| 3,980,203 | A | * 9/1976 | Dearling | 221/96 |
| 3,995,582 | A | * 12/1976 | Douglas | 118/43 |
| 4,598,664 | A | * 7/1986 | Hamlin | 118/325 |
| 5,265,509 | A | * 11/1993 | Chen | 83/282 |

FOREIGN PATENT DOCUMENTS

| | | | |
|---|---|---|---|
| CH | 653874 | * | 1/1986 |
| DE | 3101474 | * | 8/1982 |
| DE | 3109205 | * | 9/1982 |
| DE | 3409905 | * | 9/1985 |
| DE | 3922159 | * | 1/1991 |
| EP | 0680721 | * | 5/1995 |
| GB | 1222465 | * | 2/1971 |
| GB | 2045722 | * | 11/1980 |
| WO | WO 88/01459 | * | 2/1988 |
| WO | WO 93/04622 | * | 3/1993 |

* cited by examiner

*Primary Examiner*—Laura Edwards
(74) *Attorney, Agent, or Firm*—Seldon & Scillieri LLP

(57) ABSTRACT

A tissue dispenser is disclosed which permits a user to choose from a variety of liquids to be sprayed on a tissue prior to dispensing. To prevent the tissue from dissolving or becomes too wet to handle comfortably, the dispenser folds the tissue into a double layered structure prior to spraying with the selected liquid, and sprays one layer of the two-layer structure just prior to dispensing so that the dry layer can support the paper's shape and enable the user to handle the tissue without tearing it.

6 Claims, 7 Drawing Sheets

WET/DRY TISSUE DISPENSER

This invention is related to a dispenser for suppling a user with tissue paper that is dry or wetted by one or more of a plurality of selectable liquids according to the user's choice.

BACKGROUND

Wet tissue is preferred by the public for all kinds of purposes, such as cleaning, refreshing or hygienic needs. Conventionally chosen liquids include, but are not limited to, mineral water, lemon solutions, detergent solutions, perfumes, oils and alcohol.

The applicant is aware of various patents directed to such dispensers. Most of them are based on the immersion of the tissue paper into a liquid. (See, for example, U.S. Pat. No. 4,598,664, U.S. Pat. 3,980,203, U.S. Pat. No. 3,979,781, EP 0,680,721, DE 3,922,159, DE 3,409,905, DE 3,109,205, WO 88/01459, U.S. Pat. No. 3,995,582, U.S. Pat. No. 3,837,595, GB 1,222,465). Other patents disclose machines based on a spraying method. (See, for example, U.S. Pat. No. 5,265,509, U.S. Pat. No. 504,456, U.S. Pat. No. 3,804,061, U.S. Pat. No. 3,776,773, GB 2,045,722, WO 9,304,622, DE 3,101,474, CH 653874.)

The stated purposes of all these foregoing patents is to provide wet tissue. To applicant's knowledge, however, none of the disclosed devices have been commercialized on a significant scale.

SUMMARY OF THE INVENTION

There is still a need to provide a flexible and efficient method of delivering a wet tissue at will, the wetting operation being performed at the time of delivery, with a choice between different liquids. It is also desirable that the degree of wetting be adjustable, and that the tissue be folded so that one side is relatively dry for easy handling. Normally, spraying a tissue will end in a wet paper that will be difficult to use as the paper dissolves or becomes too wet to handle comfortably.

According to the present invention the tissue is folded and a selected liquid is sprayed only on one side. Folding the tissue into double layers and keeping one layer dry yields, in addition to the wet layer, a dry layer which is able to support the paper's shape so that the user can still use the paper without tearing it.

In addition, the tissue paper in the preferred dispenser is sprayed immediately before using the tissue so that it will not be substantially dissolved at the time of dispensing, as is the case with usual pre-wetted paper tissue.

According to another aspect of the invention, there is a substantial advantage in the way this machine dispenses the tissue to the user. Because a pulling out of wet tissue can easily result in torn paper in hand and the tissue's pieces stuck in the machine, the dispenser herein comprises an unloading mechanism to dispense the tissue to the user or to drop it—e.g., in a basket—if the user fails to take the tissue.

Another advantage lies in the fact that with this invention the user can have a choice of one or more pre-installed liquids according to the user's immediate needs. For example a mother talking care of her child can first use a tissue sprayed with liquid detergent, and then a tissue sprayed with mineral water or other pre-installed oily emulsion. Moreover, by using an optional electronic selector, the dispenser can permit the user to choose the amount of liquid sprayed, in order to overcome the difference in viscosity of the liquid and/or the difference in the properties of the tissue paper being used.

A further advantage lies in the fact that the liquids can preferably be stored in replaceable closed containers, reducing the possibility of contamination as can occur with open containers or containers that are no replaced.

DESCRIPTION OF THE PREFERRED EMBODIMENT

Figure 1:
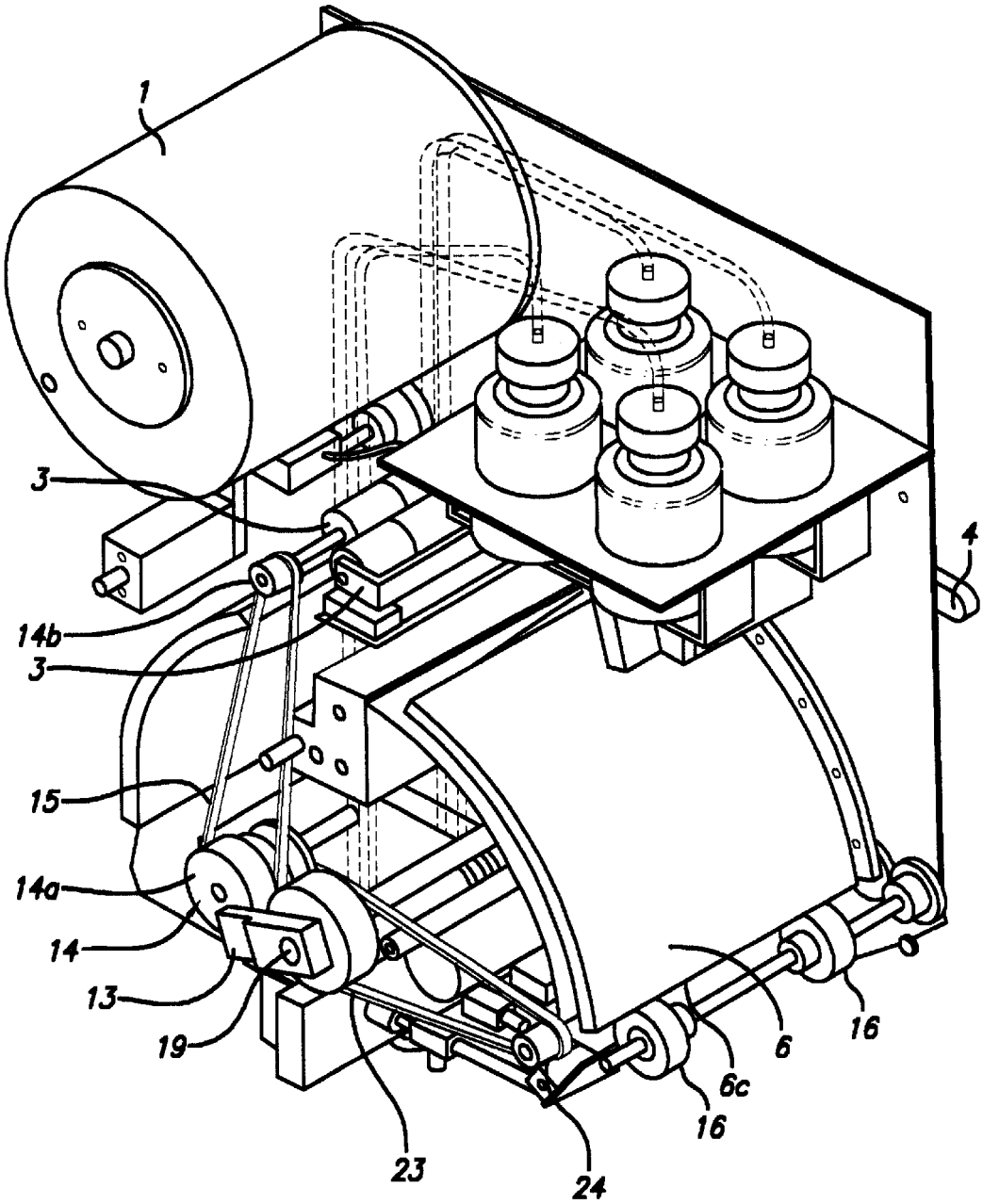
FIG. 1 is an isometric view of the front and left side of a preferred embodiment of a dry/wet tissue dispenser constructed in accordance with the invention.
Figure 2:
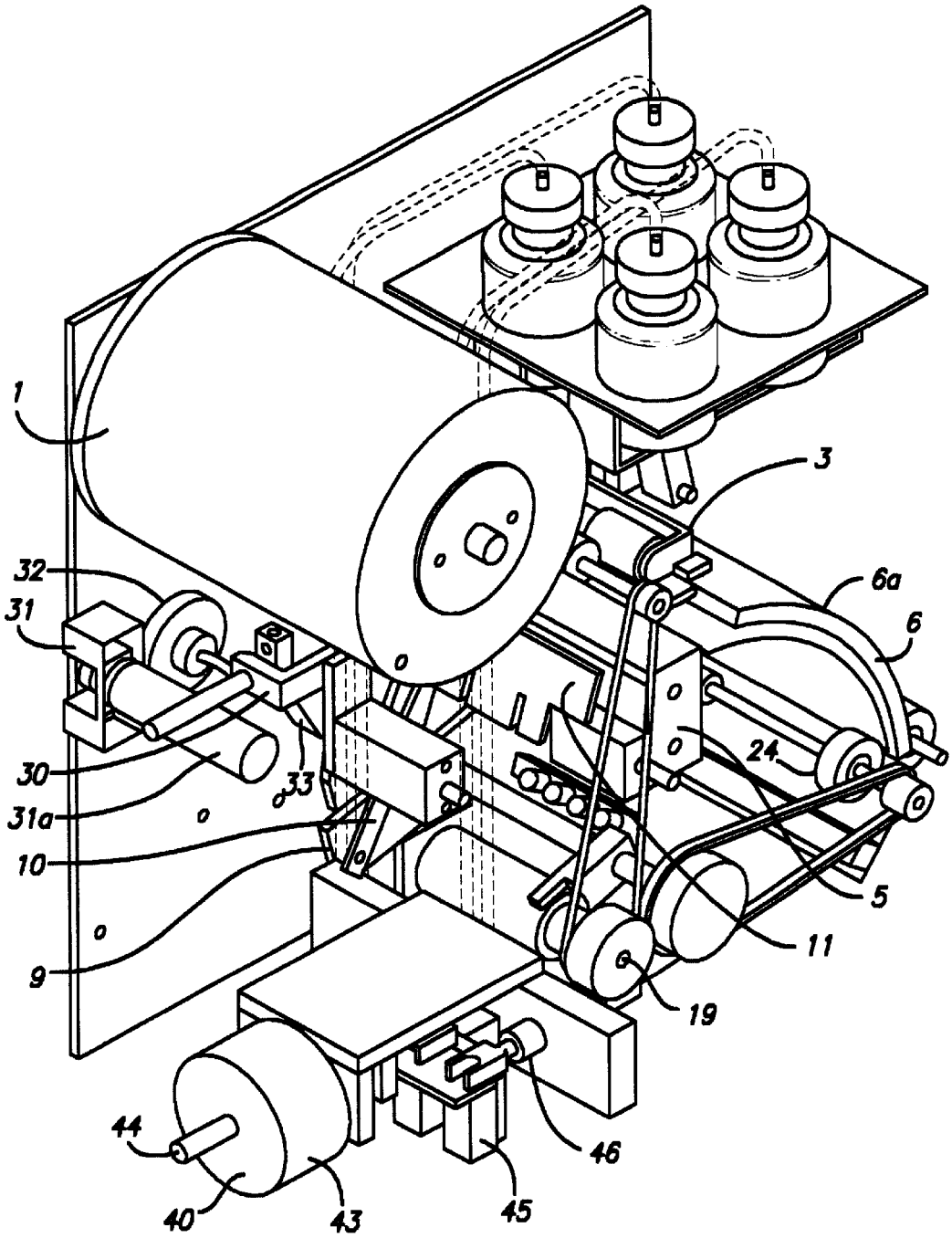
FIG. 2 is an isometric view of the rear and left side of the dispenser illustrated in FIG. 1.
Figure 3:
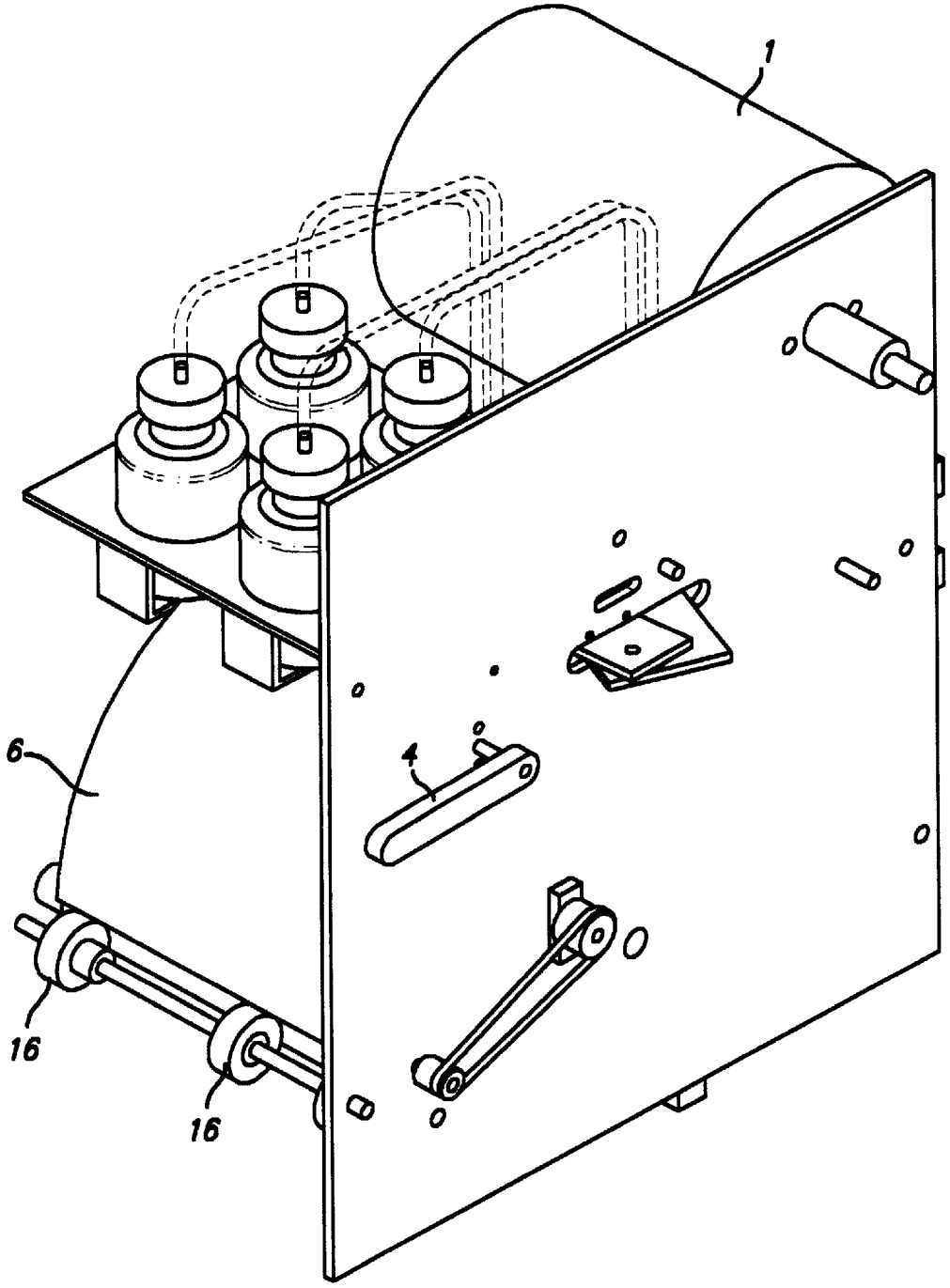
FIG. 3 is an isometric view of the front and right side of the dispenser illustrated in FIG. 1.
Figure 4:
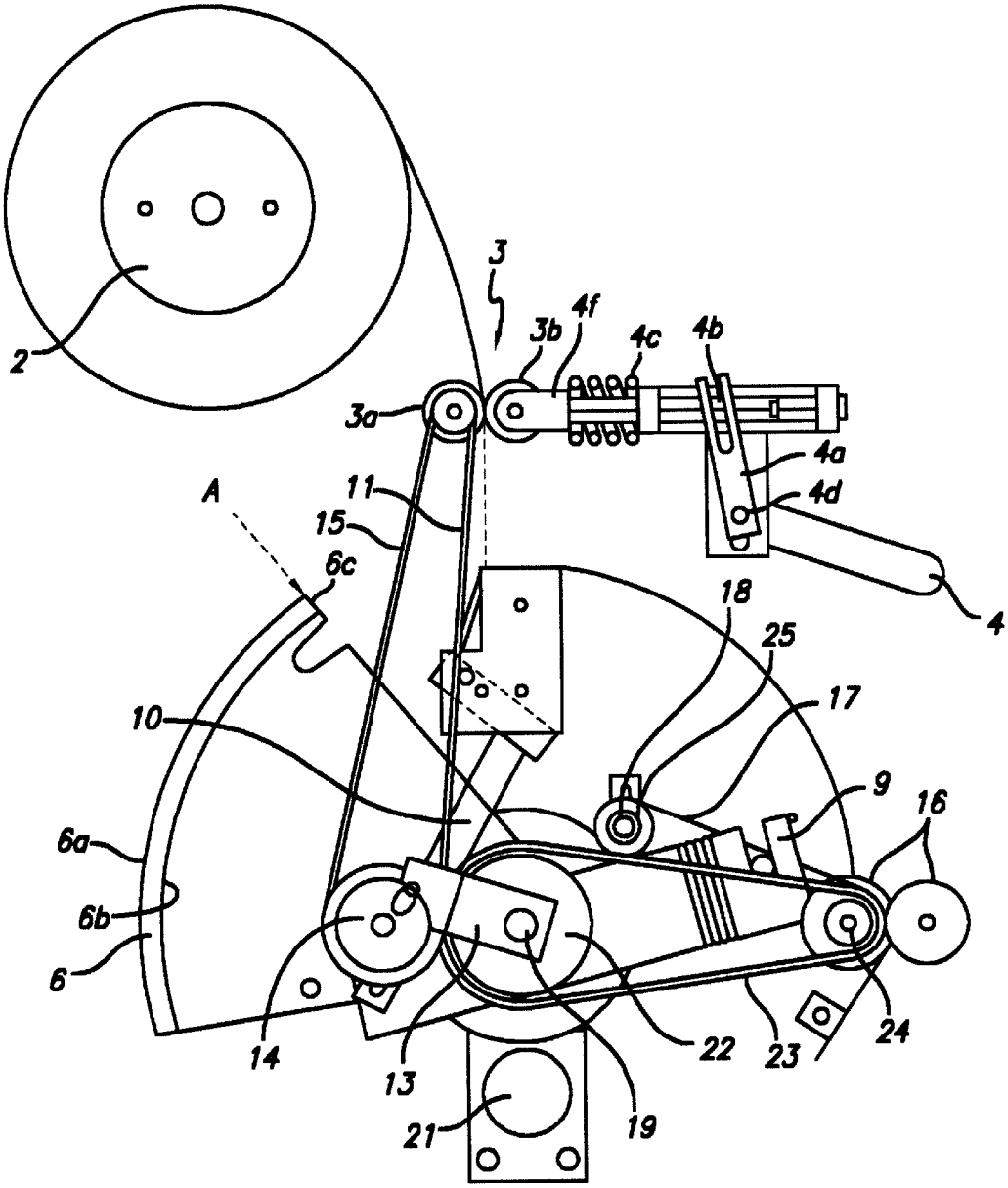
FIG. 4 is a left side view in schematic of the dispenser illustrated in FIG. 1 showing the spreader arm in Position "A"
Figure 5:
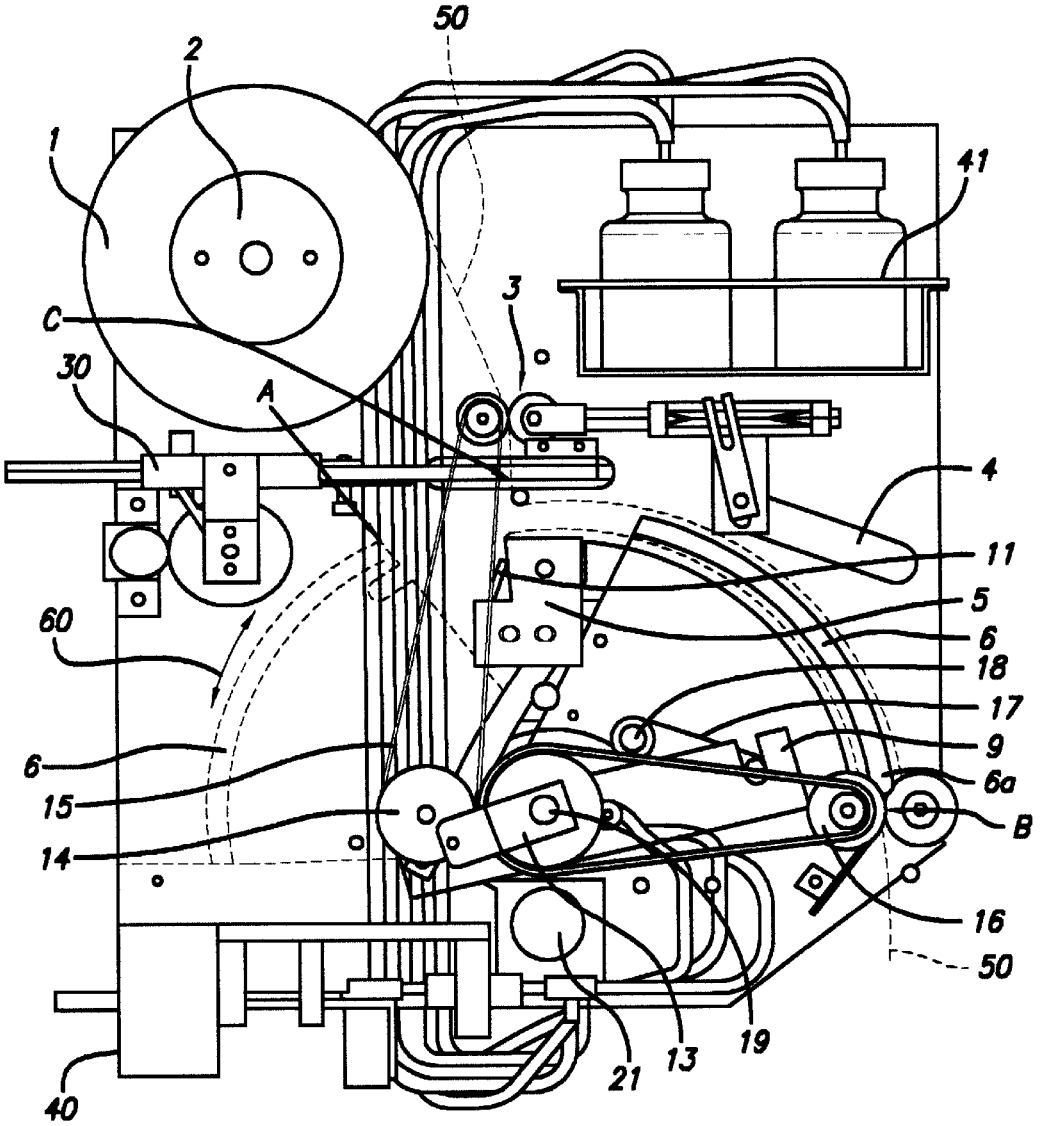
FIG. 5 is a left side view in schematic of the dispenser illustrated in FIG. 1 showing the spreader arm in Position "B"

Initial reference is made to FIGS. 1–5. FIG. 1 is an isometric view of the front and left side of a preferred embodiment of a dry/wet tissue dispenser constructed in accordance with the invention. FIG. 2 is an isometric view of the rear and left side of the dispenser illustrated in FIG. 1. FIG. 3 is an isometric view of the front and right side of the dispenser illustrated in FIG. 1. FIGS. 4 and 5 are each a left side view in schematic of the dispenser illustrated in FIG. 1. For clarity, FIGS. 1–5 omit the dispenser's housing.

Briefly, as best shown in FIGS. 2 and 4, a continuous sheet of tissue paper is pulled off the roll 1 by a loading roller assembly 3 until the leading end portion of the tissue paper enters a locking mechanism 11, where it is captured. As best illustrated in FIGS. 1 and 4, a spreader 6, mounted for rotation about a central shaft 19, is rotated clockwise by an electric motor 21 (FIGS. 4, 5) so that its leading edge 6*c* engages the sheet of tissue at a region between the roller assembly 3 and the locking mechanism 11. As the spreader 6 continues to rotate clockwise, and the leading end of the tissue remains captured in the locking mechanism, the spreader causes additional tissue to be pulled from the roll 1 and to pass over, around and under the spreader, forming a double layer of tissue with the spreader in-between, as illustrated in FIG. 5.

As further illustrated in FIG. 5, the leading edge of the spreader 6, at the end of its clockwise rotation (identified as position "B"), inserts the tissue between a pair of opposing discharge rollers 16. At approximately the same time, a blade mechanism 30 cuts the tissue just downstream from the loading roller assembly 3, and the top layer of tissue is sprayed with a selected liquid.

The spreader 6 then begins to rotate counterclockwise towards its initial position depicted in dotted lines as position "A" in FIG. 4. The counterclockwise rotation of the spreader causes the discharge rollers 16 to rotate, dispensing the double layered tissue from the dispenser, and causes the loading rollers 3 to again feed tissue from the roll 1 into the locking mechanism in preparation for the next dispensing cycle.

To initially load the dispenser, the leading edge portion of the tissue is manually pulled downward from the roll 1 and inserted within the loading roller assembly 3. The loading roller assembly 3 comprises a first roller 3*a* and an opposing slidable roller 3*b*. The opposing pair of rollers 3*a*, 3*b* are positioned to engage the top and bottom surfaces of the left side edge region of the tissue. A second and identical opposing pair of rollers (not shown) are positioned to engage the top and bottom surfaces of the right side edge region of the tissue.

The rollers of each opposing pair are coupled to each other for responsive rotational movement so, for example, roller 3*b* will rotate counterclockwise when roller 3*a*, rotates clockwise in order to feed tissue downward to the locking mechanism 11. The coupling may be frictional contact between the rollers themselves, by means of meshing gears respectively mounted for co-axial rotation with the rollers, or by other means known in the art to cause such responsive rotation. Those skilled in the art will also recognize that the rollers can be urged towards each other by a spring or similar means to insure good frictional contact, proper gear interaction, and the like.

To create a tissue-accepting gap between the rollers of each opposing pair in order to initially load the tissue, one of the rollers of each pair is mounted for movement away from the other roller of the pair via linkage that is conveniently manually activated by a lever 4. As the lever 4 is pushed downward, it causes a slight clockwise pivoting of a link member 4*a* about an axis 4*d*. The distal end of the link member 4*a* has a slot which engages a pin 4*b* affixed to a slidable arm 4*f* to which the movable roller is affixed. As the pin 4*b* is pulled to the right in FIG. 2, the movement of slidable arm 4*f* compresses a spring 4*c* that is captured between the movable roller and a frame within which the slidable arm is mounted. When the lever 4 is released, the displaced roller is thereby urged back against its mate, capturing the tissue therebetween.

The mates of the two displaceable rollers 3*a* are rotated at the appropriate time by a loading-pulley mechanism 14, 15 in order to feed the tissue through the rollers. The displaceable rollers are conveniently linked to their respective mates by respective gear mechanisms that are co-axially affixed to the rollers for rotational movement therewith. Accordingly, a gear (not shown) is affixed behind each illustrated roller 3 for co-axial rotation, with the gear pair meshing so that clockwise rotation of the left roller 3*a* causes a counterclockwise rotation of the right roller 3*b*.

The loading-pulley mechanism driving the left roller 3*a* comprises a driving pulley wheel 14*a*, a driven pulley wheel 14*b* affixed to the left roller 3*a* for co-axial rotation therewith, and a belt or chain 15 engaging the driving wheel 14a and the driven wheel 14*b* so that the driven wheel rotates clockwise in response to clockwise rotation of the driving wheel.

The driving wheel 14*a* is rotated by a cam 13 affixed to the main shaft 19.

As the rollers 3*a*, 3*b* rotate, the leading edge portion of the tissue is fed into the locking mechanism comprising a block 5 and a locking plate 11. The locking plate 11 pivots about an axis defined by a pin 11*a* that extends through the bottom of the plate between an opposing pair of pin-receiving holes in the block. As will be described later, the locking plate 11 is pivoted clockwise (in FIG. 5) to capture the leading edge portion of the tissue against the block, and is pivoted counterclockwise (in FIG. 5) at the appropriate time to release the tissue.

The spreader 6 forms and positions a double layer of tissue within the dispenser so that a liquid can be sprayed or otherwise applied to one layer of the tissue prior to being dispensed. The dispenser may have operator-selectable means for determining whether or not the tissue is sprayed, and may also permit the operator to choose which of a plurality of liquids is applied to the tissue.

The spreader preferably has an arcuate tissue-supporting upper surface 6*a* with a width approximating that of the dispensed tissue, a lower tissue-guiding surface 6*a*, and a leading edge 6*c*. As best shown in FIGS. 4 and 5, the shaft 19 rotates the leading edge 6c of the spreader clockwise from a first position "A" (illustrated in FIG. 4) to a second position "B" (illustrated in FIG. 5). As it moves towards its position "B", the spreader's leading edge 6*c* engages the tissue extending from the roll 1 to the locking mechanism 5, 11, causing a further unrolling of tissue from the roll. The unrolling tissue travels through the rollers 3, across the spreader's upper surface 6*a*, around the spreader's leading edge 6*c* and across the spreader's lower surface 6*a*. Thus, as it approaches position "B", the spreader has effectively folded the tissue into a double layer of tissue, with the spreader itself interjacent the upper and lower tissue layers.

As the spreader 6 reached position B, it pushes the locking mechanism 11 to release the captured end of the tissue. The plate 11 is activated by the lever 9 via a link 10 both for opening and closing the locking mechanism. Specifically, the locking mechanism is released by the counterclockwise movement of lock-release link 10 about an axis 10*a*, which causes the locking plate 11 to pivot away from the block 5. The counterclockwise movement of the link 10, in turn, is caused by the counterclockwise movement of the spreader 6.

Figure 6:
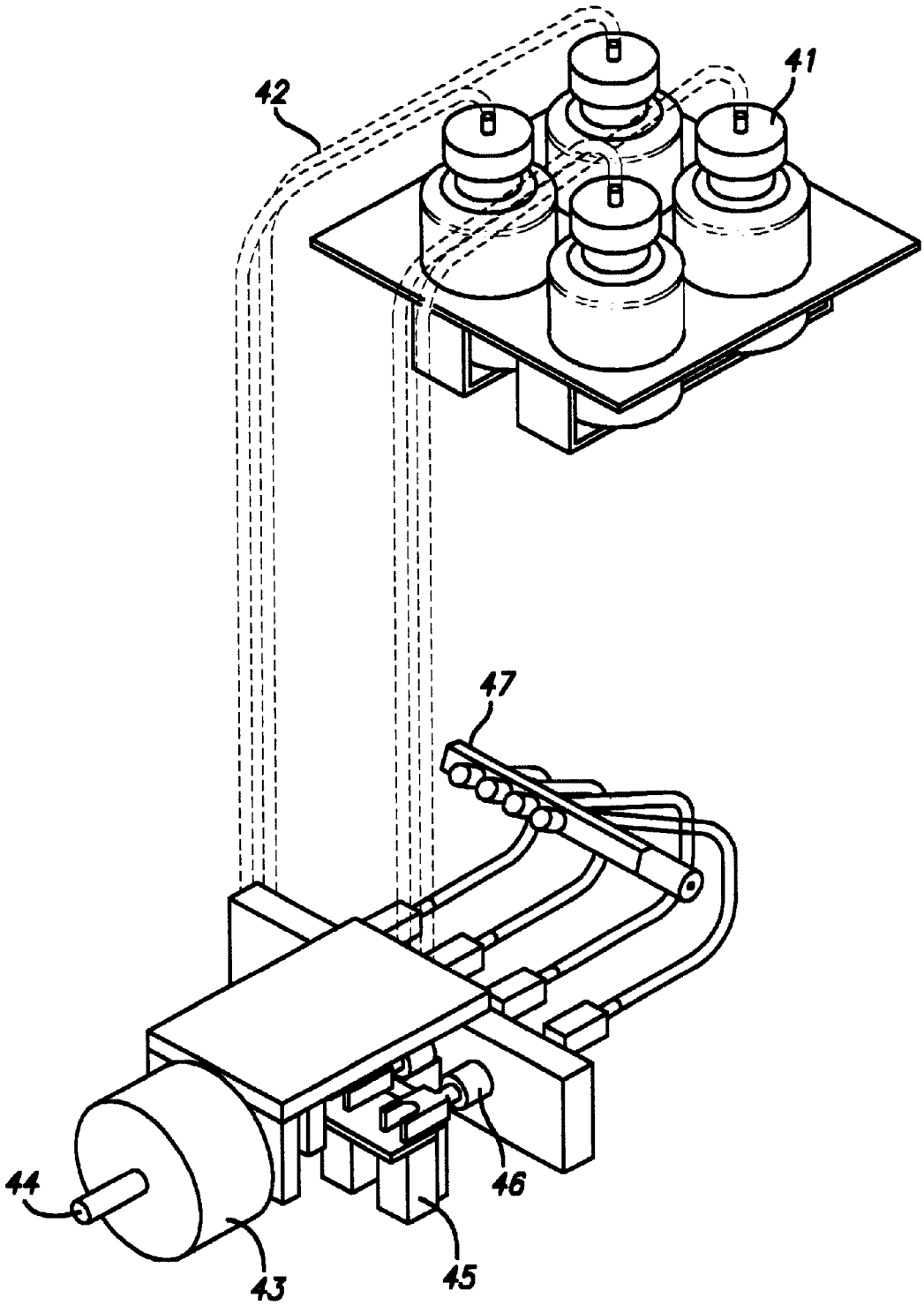
FIG. 6 is a fragmentary isometric view of the cutter assembly of the dispenser shown in FIG. 2, showing features thereof more clearly.
Figure 7:
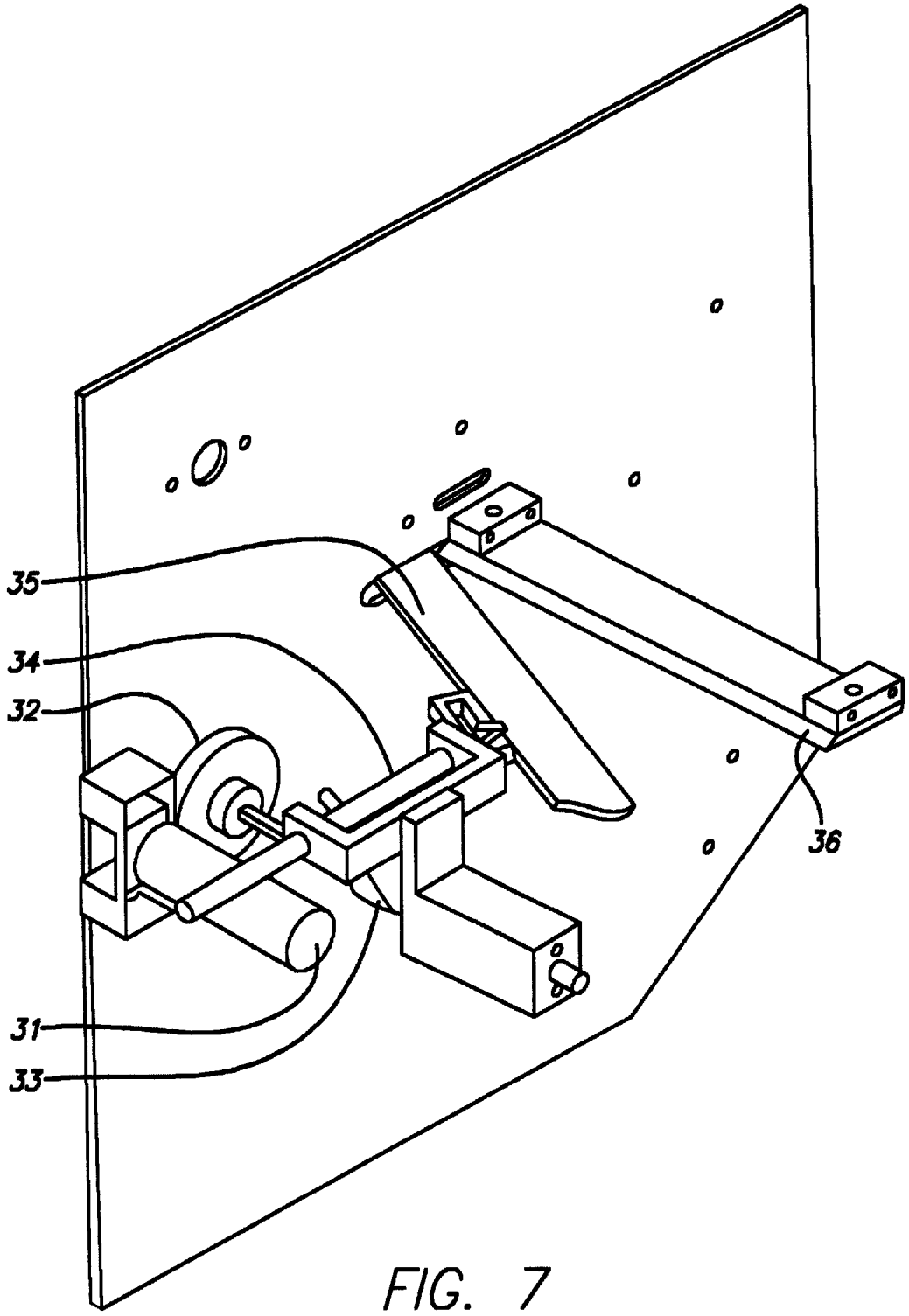
FIG. 7 is an isometric view of the rear and left side of the dispenser, similar to the view of FIG. 2, but with components removed to better show the preferred cutting mechanism.

As the spreader 6 reaches position "B", it also triggers a solenoid or other suitable switch to activate an electric cutting mechanism. As shown in FIGS. 2 and 6, the cutting mechanism comprises a cutter motor 31 that rotates a drive shaft 31*a*, causing rotation of a gear 32 and the rod 34. The rod 34 pushes/pulls a movable blade 35 against a static blade 36 in a scissor-like action to cut the tissue just downstream of the rollers 3.

At position "B", the spreader's leading edge 6*c* urges the double layer of tissue between two pairs of spongy dispensing rollers 16. At the same time, the appropriate liquid, from the reservoirs 41, is also sprayed on the internal side of the tissue paper by the nozzles system 40.

The spray system includes containers 41, pipes, a pump system and nozzles. The pump system includes one main solenoid 43 that pushes a rod 44. The selected solenoid 45 located on the rod links the relevant actuator to the rod and pushes the actuator 46. SW 3 activates this push solenoid and the selector solenoid. Selecting the liquid determines which of the selected solenoid should be operated. The liquid is pushed into the nozzles installed into the nozzle array 4'7 and sprayed on one side of the folded tissue.

After or while the tissue is sprayed, the spreader begins to rotate counterclockwise back towards position "A", leaving the double-layered tissue within the rollers. As the spreader 6 rotates counterclockwise, two things happen. First, the dispensing rollers 16 rotate to dispense the tissue. The dispensing rollers 16 are rotated by a belt 17 which transmits the clockwise rotation of a pulley wheel 25 to the left roller 16 (FIG. 5). As the spreader 6 rotates counterclockwise towards position "A", the counterclockwise rotation of the main shaft 19 causes the clockwise rotation of a gear 50 which acts on a ratchet-type one-direction clutch or ratchet 18. The clutch 18 transmits only counterclockwise movement of the gear 50—not clockwise movement—to a pulley wheel 25. The resulting clockwise movement of the pulley wheel 25 creates clockwise rotation of the left rollers 16, which in turn causes counterclockwise rotation of their mates via a pair of meshing gears respectively coupled behind the rollers for co-axial rotation therewith.

Second, the rollers 3 are rotated to feed a fresh sheet of tissue to the locking mechanism 3, readying the dispenser for the next dispensing cycle. The counterclockwise rotation of the spreader causes a clockwise rotation of the pulley wheel 14, which imparts a clockwise rotation to the left roller 3 via the connecting belt 15. The clockwise rotation of the left roller 3 imparts a counterclockwise rotation to the right roller 3 via meshing gears mounted for respective co-axial rotation behind each roller.

If tissue paper from the previous dispensing cycle has not been removed from the dispenser by the user, the subsequent clockwise rotation of the spreader 6 during the next use of the dispenser will drive a second unloading system to cause the previously unused paper to be discarded. The second unloading system comprises a pulley wheel 22 driven about the main axis 19 by the rotating spreader, a belt or chain 23, and a unidirectional clutch 24. As the spreader 6 rotates clockwise, the pulley wheel 22 rotates clockwise, driving the dispensing rollers 16 counterclockwise via clutch 24 and belt 23.

The electrical components of the dispenser may be conventional. Briefly, the dispenser may conveniently include a circuit board, or control card, that includes a microprocessor that controls the relays that activate the main motor, and in the present embodiment, the cutter motor. The control card also controls the relays that activate the solenoids in the spray system.

The inputs to the microprocessor are the 4 positions SW (1–4), 5 push switches (load/dry, liquid 1, liquid 2, liquid 3, liquid 4) and the selector button to adjust the amount of liquid sprayed.

The card can be powered by a main power via a 220/12V transformer or by 2 rechargeable batteries, each 6V.

While the foregoing description includes detail which will enable those skilled in the art to practice the invention, it should be recognized that the description is illustrative in nature and that many modifications and variations will be apparent to those skilled in the art having the benefit of these teachings. For example, magnetic and/or optical sensors can be used to detect the position of the spreader 6 or other appropriate component of the dispenser during the user-activated operating cycle in order to accomplish electrically what is accomplished mechanically by belts and pulleys herein.

It is accordingly intended that the invention herein be defined solely by the claims appended hereto and that the claims be interpreted as broadly as permitted in light of the prior art.

I claim:

1. A tissue dispenser comprising:

means for holding sheet of tissue sufficient in length to provide for the needs of a plurality of users, said tissue having a leading end portion;

means for releasably securing the leading end portion of the tissue at a location removed from the holding means so as to create a length of tissue between the holding means and the securing means;

contact means movable into engagement with the tissue at a region between the holding means and the securing means and, thereafter through continued movement for causing the folding of the tissue into a plural-layer length of tissue;

cutting means for severing the plural-layer length of tissue from the tissue sheet;

means for spraying one of the plurality of tissue layers; and means for dispensing the sprayed plural-layer length of tissue from the dispenser.

2. The dispenser of claim 1 wherein the spraying means comprises a multi-ported device having a plurality of ports fluidically coupled to a respective plurality of fluid-holding containers.

3. The dispenser of claim 1 including means for permitting a user to adjust the amount of liquid to be sprayed onto the tissue.

4. The dispenser of claim 1 including means for permitting a user to select one of a plurality of available liquids for spraying on the tissue.

5. The dispenser of claim 1 including means for retaining dispensed tissue that has not been removed by a user.

6. The dispenser of claim 5 including means responsive to activation of a dispensing cycle by a user for discarding tissue dispensed but unremoved during the previous dispensing cycle, a dispensing cycle being initiated by a user desiring tissue, and ending with the dispensing of that tissue.

* * * * *